US011654320B2

(12) United States Patent
Gagne et al.

(10) Patent No.: US 11,654,320 B2
(45) **Date of Patent: *May 23, 2023**

(54) SYSTEM AND METHOD FOR EXERCISE EQUIPMENT HINGE

(71) Applicant: Kenzai Limited, Berkeley, CA (US)

(72) Inventors: Rob Gagne, Tokyo (JP); Jason Block, Tokyo (JP); Patrick Reynolds, Tiburon, CA (US)

(73) Assignee: Kenzai Limited, Berkeley, CA (US)

( * ) Notice: Subject to any disclaimer, the term of this patent is extended or adjusted under 35 U.S.C. 154(b) by 183 days.

This patent is subject to a terminal disclaimer.

(21) Appl. No.: 17/188,672

(22) Filed: Mar. 1, 2021

(65) Prior Publication Data

US 2021/0178208 A1 Jun. 17, 2021

Related U.S. Application Data

(63) Continuation of application No. 16/390,656, filed on Apr. 22, 2019, now Pat. No. 10,933,270.
(Continued)

(51) Int. Cl.
*A63B 5/20* (2006.01)

(52) U.S. Cl.
CPC ..... *A63B 5/20* (2013.01); *A63B 2209/00* (2013.01); *A63B 2220/17* (2013.01); *A63B 2220/833* (2013.01)

(58) Field of Classification Search
CPC .. A63B 5/20; A63B 5/205; A63B 5/22; A63B 15/00; A63B 15/02; A63B 21/0004; A63B 21/00043; A63B 21/012; A63B 21/0125; A63B 21/015; A63B 21/0608; A63B 21/22; A63B 21/4033;
(Continued)

(56) References Cited

U.S. PATENT DOCUMENTS 3,251,132 A * 5/1966 Hall ..... G01B 3/12 33/781
4,647,037 A 3/1987 Donohue
(Continued)

FOREIGN PATENT DOCUMENTS

CN 2331382 8/1999
CN 2404556 11/2000
(Continued)

OTHER PUBLICATIONS

International Search Report and Written Opinion issued in PCT Application No. PCT/US2019/028706 dated Jul. 29, 2019.
(Continued)

*Primary Examiner* — Gary D Urbiel Goldner
(74) *Attorney, Agent, or Firm* — Hogan Lovells US LLP

(57) ABSTRACT

A system includes a handle with a hinge mechanism at a first end, the hinge mechanism including a lower hinge portion and an upper hinge portion rotatably coupled together. The handle also includes a rotary mechanism positioned at the first end and coupled to the lower hinge portion to enable circumferential movement of the lower end portion about a longitudinal axis of the handle. Additionally, a sensor arrangement is positioned within a body of the handle, the sensor arrangement measuring a number of rotations of the rotary mechanism about the longitudinal axis of the handle.

20 Claims, 10 Drawing Sheets

Related U.S. Application Data

(60) Provisional application No. 62/661,996, filed on Apr. 24, 2018.

(58) Field of Classification Search
CPC ..... A63B 21/4035; A63B 21/4043; A63B 21/4045; A63B 21/4047; A63B 21/4049; A63B 22/0046; A63B 24/0059; A63B 24/0062; A63B 24/0087; A63B 71/0619; A63B 71/0622; A63B 71/0686; A63B 2071/065; A63B 2071/0658; A63B 2071/0669; A63B 2209/00; A63B 2209/08; A63B 2220/17; A63B 2220/30; A63B 2220/34; A63B 2220/35; A63B 2220/36; A63B 2220/40; A63B 2220/44; A63B 2220/62; A63B 2220/64; A63B 2220/80; A63B 2220/801; A63B 2220/802; A63B 2220/803; A63B 2220/805; A63B 2220/83; A63B 2220/833; A63B 2225/09; A63B 2225/093; A63B 2225/50; A63B 2225/52; A63B 2225/54; A63B 2225/74; A63B 2230/00; A63B 2230/75
See application file for complete search history.

(56) References Cited

U.S. PATENT DOCUMENTS

| | | | | |
|---|---|---|---|---|
| 5,236,405 | A | 8/1993 | Dohmann | |
| 5,662,561 | A | 9/1997 | McNamara | |
| 5,895,341 | A | 4/1999 | Jones | |
| 6,126,292 | A | 10/2000 | Liu | |
| 7,086,951 | B2 | 7/2006 | Chang | |
| D566,206 | S | 4/2008 | Yang | |
| 7,354,383 | B2 | 4/2008 | Bardha | |
| 7,462,140 | B1 | 12/2008 | Lambardozi | |
| 7,621,853 | B2 | 11/2009 | LaTour | |
| 7,976,438 | B1 * | 7/2011 | Hsu | A63B 5/20 482/81 |
| 8,136,208 | B2 | 3/2012 | Borth et al. | |
| 8,142,333 | B2 * | 3/2012 | LaTour | A63B 5/20 482/8 |
| 8,684,892 | B1 | 4/2014 | Ihli et al. | |
| 8,911,333 | B2 * | 12/2014 | Hunt | A63B 5/20 482/81 |
| 9,114,269 | B2 | 8/2015 | Lin et al. | |
| 9,492,699 | B2 | 11/2016 | Carpinelli et al. | |
| 9,717,944 | B2 * | 8/2017 | Jeon | G09B 19/003 |
| 10,391,354 | B2 | 8/2019 | Barton | |
| 10,933,270 | B2 * | 3/2021 | Gagne | A63B 5/20 |
| 2003/0134716 | A1 | 7/2003 | Yu | |
| 2005/0026749 | A1 | 2/2005 | Pak | |
| 2005/0054483 | A1 | 3/2005 | Peng | |
| 2005/0288158 | A1 | 12/2005 | LaTour | |
| 2006/0128534 | A1 | 6/2006 | Roque | |
| 2007/0129220 | A1 | 6/2007 | Bardha | |
| 2008/0142615 | A1 * | 6/2008 | Chen | B05B 12/008 239/74 |
| 2010/0063426 | A1 | 3/2010 | Planke | |
| 2010/0160116 | A1 * | 6/2010 | LaTour | A63B 5/20 482/110 |
| 2012/0088641 | A1 * | 4/2012 | Shah | A63B 23/12 482/110 |
| 2014/0024498 | A1 * | 1/2014 | Lin | A63B 5/205 482/8 |
| 2014/0038780 | A1 | 2/2014 | Lin et al. | |
| 2014/0243164 | A1 | 8/2014 | Suplee | |
| 2015/0119206 | A1 * | 4/2015 | Newman | A63B 5/20 482/82 |
| 2019/0030391 | A1 * | 1/2019 | Chuang | A63B 23/0205 |
| 2019/0321672 | A1 * | 10/2019 | Gagne | A63B 5/20 |

FOREIGN PATENT DOCUMENTS

| | | |
|---|---|---|
| CN | 205586417 | 9/2016 |
| DE | 2641383 | 3/1978 |
| KR | 200240614 | 10/2001 |
| KR | 101557237 | 10/2015 |
| WO | 2002/07826 | 1/2002 |
| WO | 2015/052073 | 4/2015 |

OTHER PUBLICATIONS

U.S. Non-Final Office Action dated Jul. 15, 2020 issued in U.S. Appl. No. 16/390,656.

U.S. Notice of Allowance dated Oct. 27, 2020 issued in U.S. Appl. No. 16/390,656.

* cited by examiner

SYSTEM AND METHOD FOR EXERCISE EQUIPMENT HINGE

CROSS REFERENCE TO RELATED APPLICATIONS

This application claims priority to U.S. Non-Provisional patent application Ser. No. 16/390,656, filed Apr. 22, 2019 titled "SYSTEM AND METHOD FOR EXERCISE EQUIPMENT HINGE", which application claims priority to Provisional Patent Application No. 62/661,996 filed Apr. 24, 2018 titled "SYSTEM AND METHOD FOR EXERCISE EQUIPMENT HINGE," the disclosure of which are incorporated herein by reference in their entirety.

BACKGROUND

Various pieces of exercise equipment may be used to build muscle, reduce body fat, and improve cardiovascular endurance. A jump rope (e.g., skipping rope) provides all of these benefits and more. In operation, a user may hold a handle in each hand, the handles being connected together via a rope. As the user rotates their wrists, the rope moves in a circular or arc-like trajectory and the user jumps into the air to avoid having the rope strike their legs as the rope makes a full rotation. Jump ropes typically include a rope that is fixed to the handles such that repeated use may lead to tangling or kinking due to the rotation.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
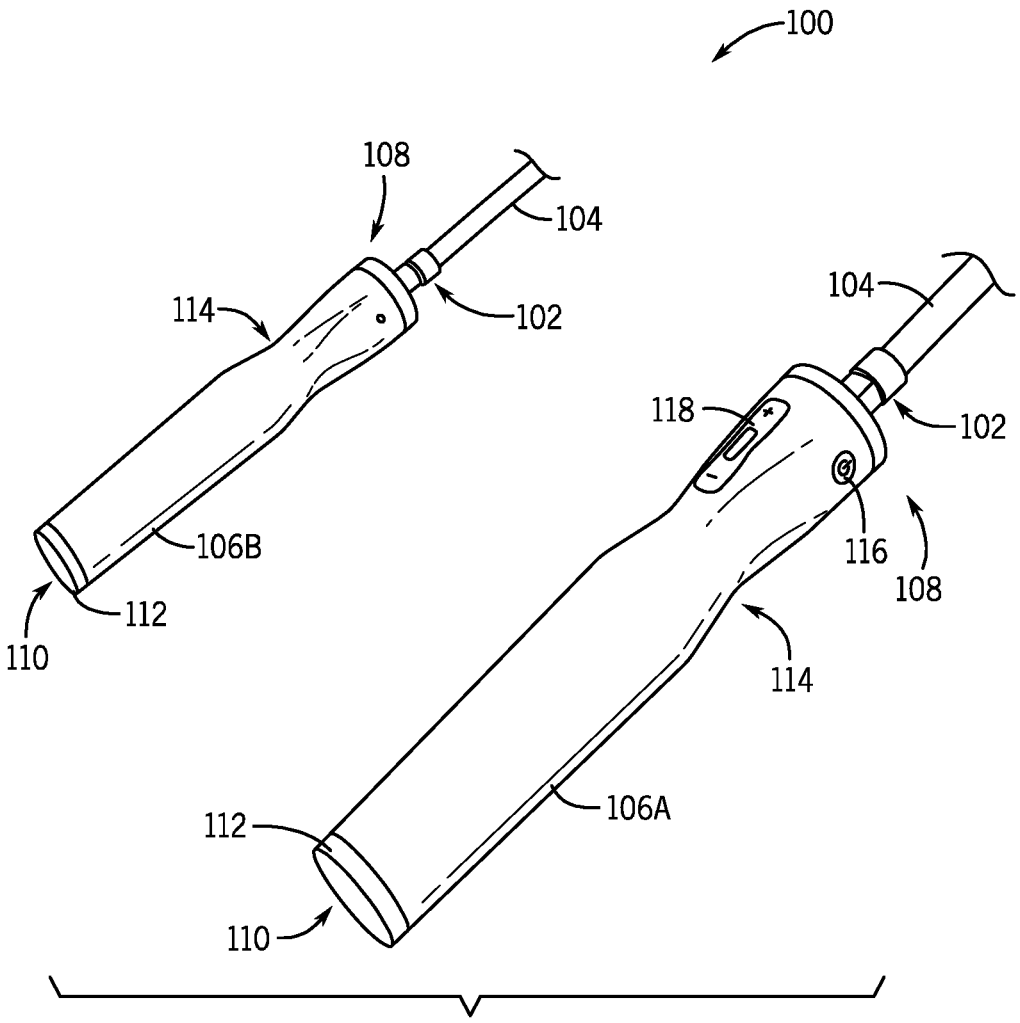
FIG. 1 is front perspective view of an embodiment of a jump rope, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Various embodiments of the present disclosure are directed toward a hinge system (e.g., hinge mechanism) for use with a jump rope. The hinge system provides rotation about a first axis for a fixed or predetermined range. In certain embodiments, the hinge mechanism acts as a mechanical bearing to connect two solid objects while enabling a limited range of motion between them. Furthermore, the hinge system provides for rotation about a second axis, perpendicular to the first axis. For example, the hinge system may include a rotary mechanism (e.g., bearing arrangement) to provide full 360-degree rotational freedom for the hinge system relative to a handle. This multi-axis movement may provide improved performance of the jump rope, as the rope may not tangle or otherwise kink during rotation of handles of the jump rope. In other words, the hinge system and accompanying bearing arrangement enable freedom of movement in at least two directions.

Various embodiments also describe one or more tracking features within the jump rope to facilitate recording and/or feedback regarding use of the jump rope. For example, various embodiments may be directed toward a smart jump rope that tracks complete rotations of the hinge and/or rope. In embodiments, the handle includes a sensor assembly that tracks rotation of the hinge system relative to the handle. Full rotations can be counted as part of the smart jump rope device and transmitted, for example to a wearable device for tracking fitness activities, via a communication protocol such as BLUETOOTH™.

FIG. 1 is a front perspective view of an embodiment of a jump rope 100 having a hinge mechanism 102 (e.g., hinge system) utilized to couple a rope 104 to handles 106. In the illustrated embodiment, the rope 104 couples to respective handles 106A, 106B via the hinge mechanism 102 at first ends 108 of the handles 106, while second ends 110 of the handles 106 include a cap 112. In certain embodiments, the cap 112 is removable to enable access to the internal components of the handles 106, which will be described in detail below. In the illustrated embodiment, the handles 106 include a contoured grip 114 to conform to the shape of a human hand, thereby improving comfort for the user operating the jump rope, for example as part of a fitness program. The illustrated handle 106A includes a switch 116, which may be an on/off button to activate the jump rope 100. As will be described, the switch 116 may transmit a signal to a battery arranged within the handle 106A to activate one or more components within the handle 106A, such as a printed circuit board and/or a display. Additionally, the handle 106A includes a toggle switch 118 that may be utilized to scroll through settings, which may be presented to the user on a display (not pictured) which may be formed in the handle 106A. The display may include data regarding the exercise performed by the user (e.g., number of rotations, time, calories burned, etc.) or information regarding operation of the jump rope 100 (e.g., battery life, connectivity, etc.).

It should be appreciated that various features illustrated in the jump rope 100 are for illustrative purposes and are not intended to limit the scope of the disclosure. For example, while the power switch 116 and the toggle switch 118 are illustrated on the handle 106A, it should be appreciated that the switches 116, 118 may not be on the same handle 106. Furthermore, the functionality may be integrated into a single switch. For example, the power switch 116 may be formed between the selectors of the toggle switch 118.

Figure 2:
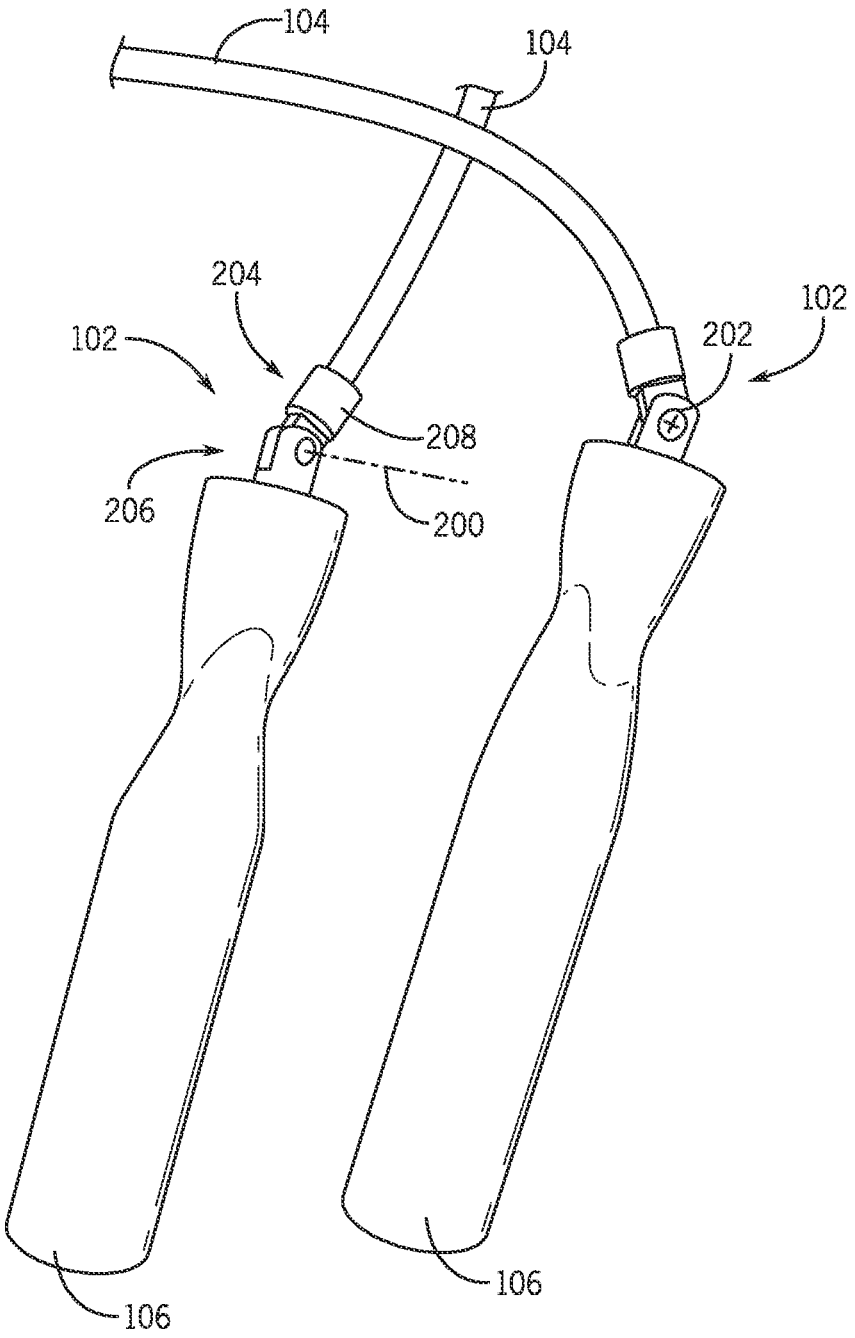
FIG. 2 is a top plan view of handles of a jump rope, in accordance with embodiments of the present disclosure.

FIG. 2 is a top plan view of an embodiment of the jump rope 100 illustrating the handles 106 being coupled together via the rope 104 that is connected to the handles 106 via respective hinge mechanisms 102. The illustrated hinge mechanisms 102 enable 180 degree rotation relative to an axis 200 (e.g., a first axis, a rope axis) extending through a fastener 202. That is, the hinge mechanism 102 enables plus or minus 90 degrees of rotational movement about the axis 200. It should be appreciated that in other embodiments the range of movement about the axis 200 may be different. For example, the illustrated hinge mechanisms 102 may enable approximately 220 degrees of rotation relative to the axis 200 (e.g., about the axis 200) extending through the fastener 202. In various embodiments, the hinge mechanism 102 enables plus or minus 110 degrees of rotational movement about the axis 200. Further, in certain embodiments, the range of rotation about the axis 200 may be approximately 140 degrees. It should be appreciated that various ranges of movement about the axis 200 may be provided in order to facilitate smooth movement of the rope 104 in an arching path as the handle 106 is rotated. As illustrated, the hinge mechanism 102 includes an upper hinge portion 204 and a lower hinge portion 206. The upper hinge portion 204 includes a tube 208 that receives the rope 104. The tube 208, or at least a portion coupled to the tube 208, is inserted into the lower hinge portion 206 and coupled together via the fastener 202, such as a screw or a pin. In other words, the upper hinge portion 204 is coupled to the lower hinge portion 206. The fastener 202 acts as a pivot point for the hinge mechanism 102, thereby enabling rotation of the upper hinge portion 204 about the fastener 202 (e.g., about the axis 200) over a range of approximately 180 degrees, in certain embodiments, but as noted above the range can be particularly adjusted.

Figure 3:
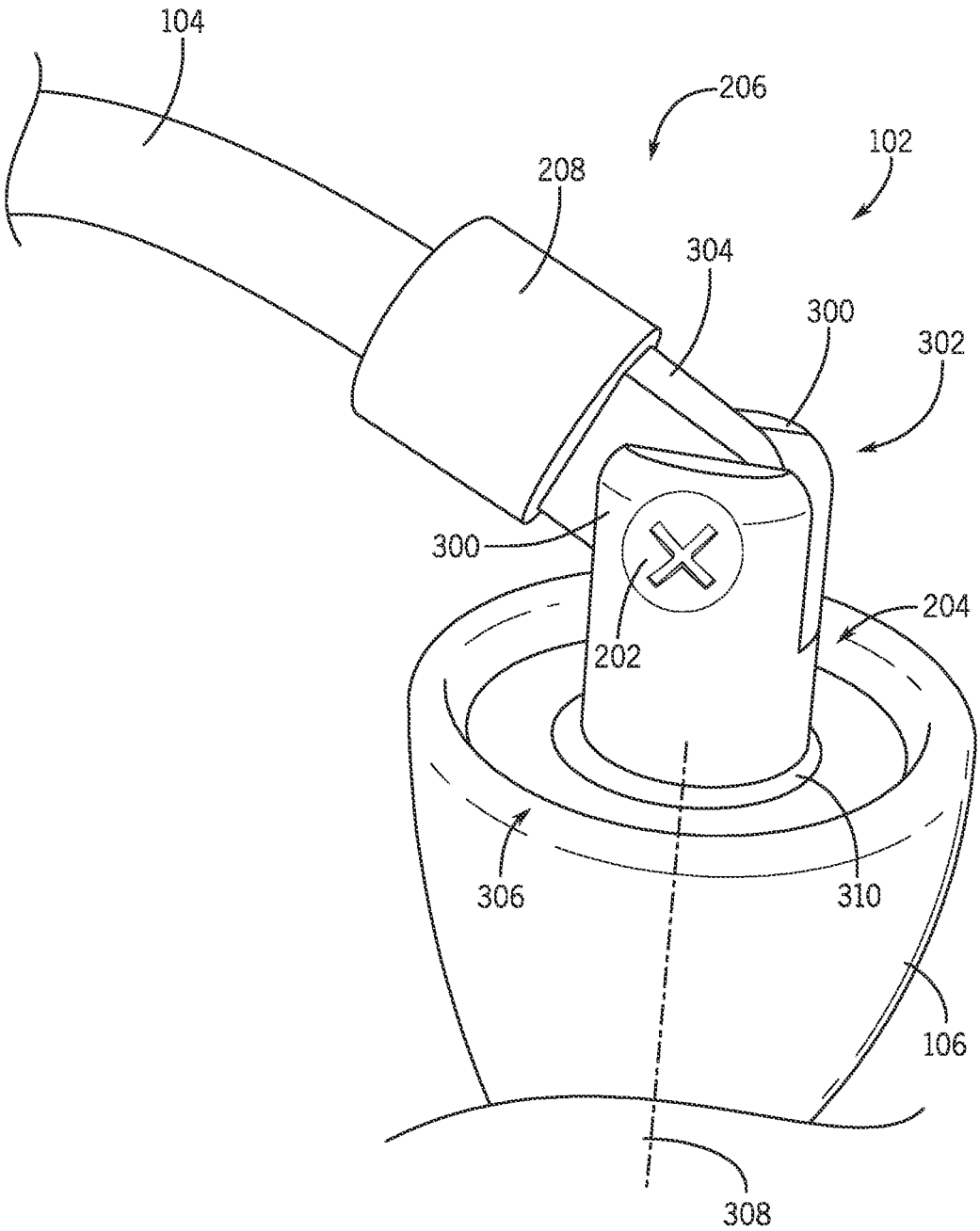
FIG. 3 perspective view of an embodiment of a hinge mechanism, in accordance with embodiments of the present disclosure.

FIG. 3 is a front perspective view of an embodiment of the handle 106 including the hinge mechanism 102 having the upper hinge portion 204 and the lower hinge portion 206. As shown, the upper hinge portion 204 is inserted into the lower hinge portion 206. The lower hinge portion includes a pair of arms 300 that extend upwardly and away from the handle 106 to thereby form a cavity or slot 302 to receive the upper hinge portion 204. In various embodiments, the upper hinge portion 204 includes a tab 304 (e.g., extension, insert, etc.) that is arranged between the arms 300 of the lower hinge portion 206. For example, the tab 304 may be a portion of the tube 208 that receives the rope 104. In various embodiments, the tab 304 is integrally formed to the tube 208. However, in various embodiments, the tab 304 may be a separate attachable component. Furthermore, in embodiments, the rope 104 may be a replaceable component, and as a result, the rope 104 may be a separate component that also includes the tube 208 and/or the tab 304. In this manner, ropes 104 may be easily changed out and replaced while still including the tube 208 and/or tab 304 to facilitate coupling to the lower hinge portion 206. Additionally, in various embodiments, the tab 304 may not be present and the tube 208 may have a diameter to facilitate insertion into the slot 302. The fastener 202 in the illustrated embodiment is a screw, but it should be appreciated that other fasteners, such as pins, dowel rods, or the like may be utilized. As described above, the hinge mechanism 102 enables rotation of the upper hinge portion 204 about the axis 200 extending through the fastener 202.

The embodiment illustrated in FIG. 3 has removed an upper cap (FIG. 8) from the handle 106 to provide visual access to a rotary mechanism 306 (e.g., bearing system) enabling rotational movement of the hinge system 102 relative to a longitudinal axis 308 of the handle 106. Accordingly, the upper hinge portion 204 has at least two degrees of freedom of movement. That is, the upper hinge portion 204 may rotate about the longitudinal axis 308 (e.g., via the rotary mechanism 306) and also rotate about the axis 200. The rotary mechanism 306 may include one or more bearings 310, such as ball bearings or journal bearings, to enable 360-degree rotation of the hinge system 102 relative to the longitudinal axis 308 of the handle 106. As will be described below, the lower hinge portion 206 may include a protrusion that extends through an aperture formed in the rotary mechanism 306 to thereby receive and support the lower hinge portion 206. The above-described hinge mechanism 102 provides an accurate tracking of skips (described below) while providing an authentic jumping experience in which the rope 104 is not tangled or otherwise interferes with the jumping action. For example, if the rope 104 were to come straight out of the handle 106 (e.g., without the hinge mechanism 102), then the number of skips may not be accurately counted due to the limited range of motion of the rope 104. Furthermore, fixing the rope 104 at an angle, such as straight out from the handle 106, may limit the motion of the rope 104 and/or the ability of the user to perform certain jump tricks due to the restriction caused by the position of the rope 104.

Figure 4:
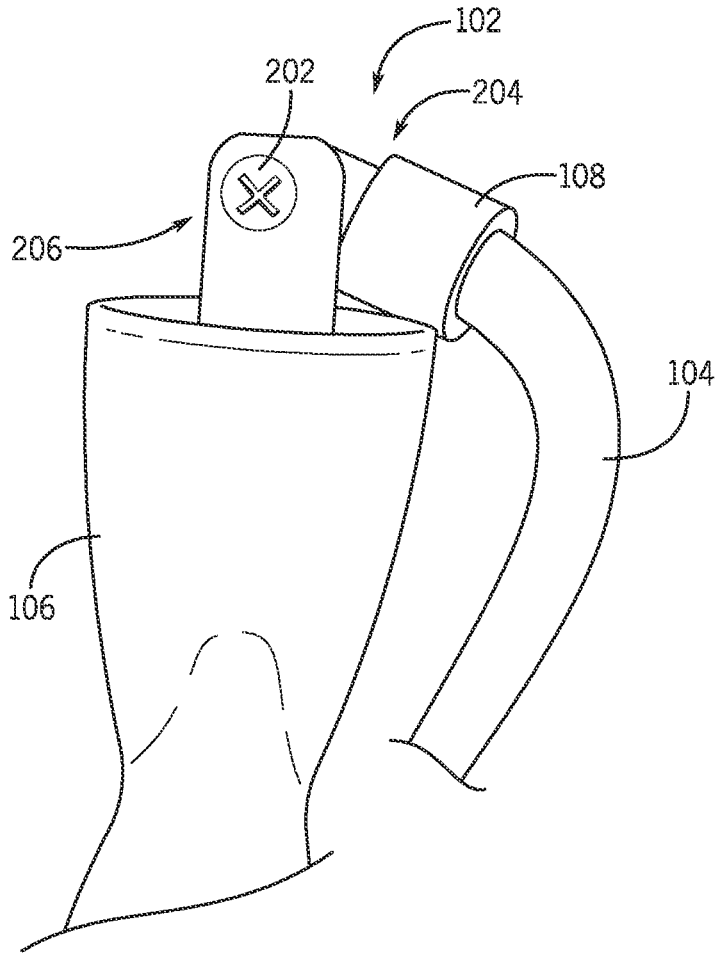
FIG. 4 is a side elevational view of an embodiment of a hinge mechanism, in accordance with embodiments of the present disclosure.

FIG. 4 is a side elevational view of an embodiment of the hinge mechanism 102 in which the upper hinge portion 204 is at an upper boundary of the range of motion. In certain embodiments, the upper hinge portion 204 may contact the handle 106 to thereby prevent further rotation about the axis 200 extending through the fastener 202. In the illustrated embodiment, the axis 200 extends substantially perpendicular to the plane of the page. However, in certain embodiments, a stop or other mechanism (not pictured) may be arranged on the hinge mechanism 102 to limit the rotation of the upper hinge portion (206). For example, the stop may extend from the lower hinge portion 204 to block the upper hinge portion 204 from contacting the handle 206. In the illustrated embodiment, the rope 104 is illustrated as extending into and being secured within the upper hinge portion 204. For example, the rope 104 extends into the tube 208. The rope 104 may include a sheath or cover, for example made of a polymer material.

Figure 5B:
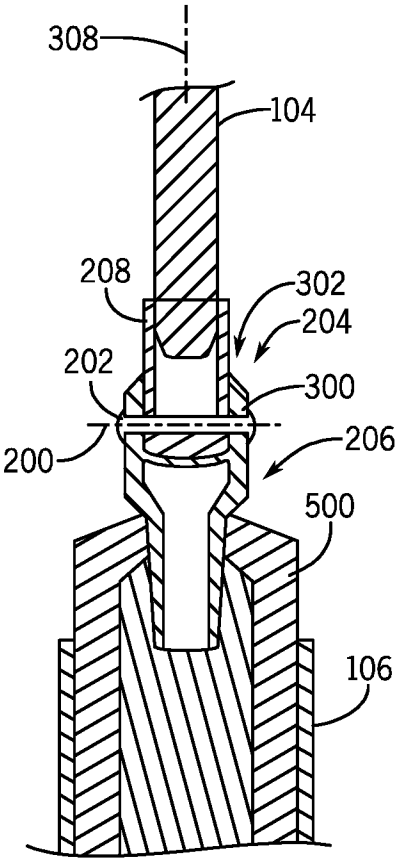
FIG. 5B is a partial cross-sectional view of an embodiment of a handle, in accordance with embodiments of the present disclosure.
Figure 5A:
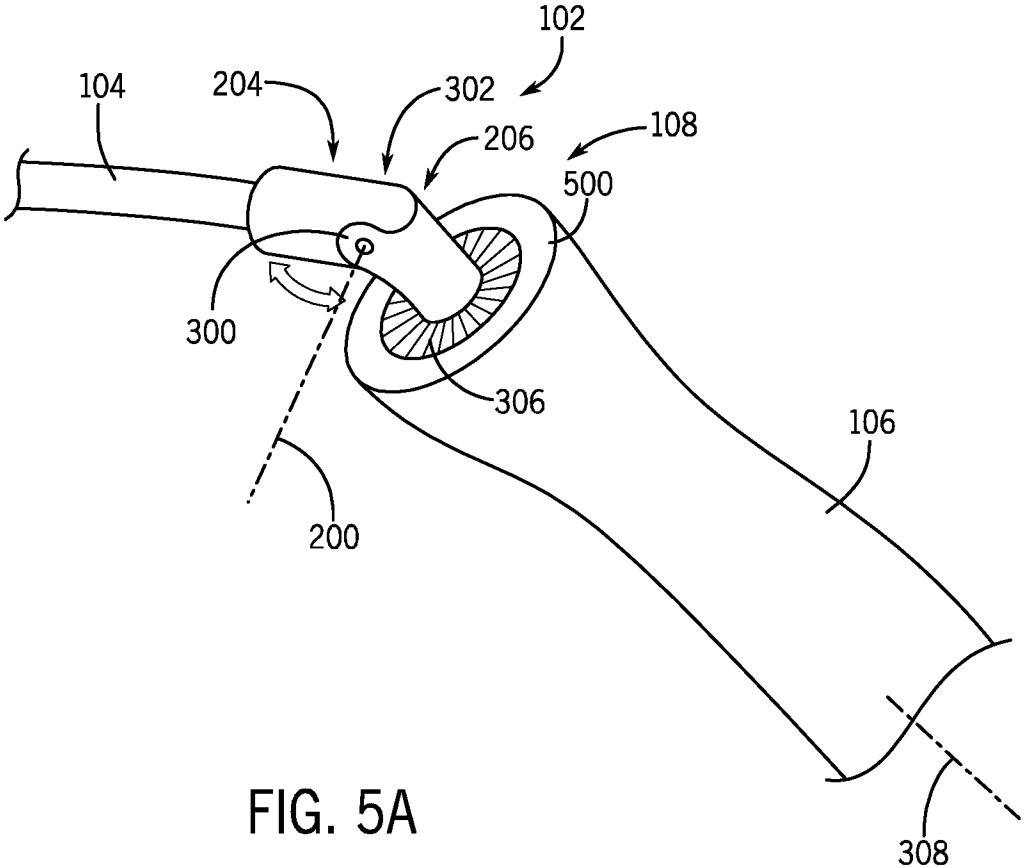
FIG. 5A is a perspective view of an embodiment of a handle, in accordance with embodiments of the present disclosure.

FIG. 5A is a schematic perspective view of an embodiment of the handle 106. As shown, the rope 104 extends and couples to the upper hinge portion 204, which extends into the slot 302 formed in the lower hinge portion 206 and is secured via the fastener 202. In the illustrated embodiment, the handle 106 includes a clamp 500 arranged proximate the hinge mechanism 102. The clamp 500 may be utilized to tighten the rope 104 and/or the hinge mechanism 102. That is, the clamp 500 may be used to provide friction to thereby reduce a speed at which the hinge mechanism 102 rotates about the longitudinal axis 308 of the handle 106. Moreover, in embodiments, the clamp 500 may be used to secure the hinge mechanism 102 to the handle 106.

In the illustrated embodiment, the clamp 500 is arranged proximate an outer diameter of the first end 108 of the handle 106. The clamp 500 may include threads or the like to couple to the handle 106 and may, in various embodiments, apply a pressure or frictional force to the rotary mechanism 306. For example, in the illustrated embodiment, the rotary mechanism 306 is positioned radially inward from the clamp 500. Moreover, the rotary mechanism 306 and clamp 500 are coaxial along the longitudinal axis 308. In various embodiments, rotation of the clamp 500, about the longitudinal axis 308, in a first direction may apply a force to the rotary mechanism 306, such as along an outer diameter of the rotary mechanism 306, while rotation in a second rotation may release or remove a force from the rotary mechanism 306. However, it should also be appreciated that the clamp 500 may be utilized to apply a frictional force to the lower hinge portion 206. For example, as illustrated in FIG. 5B.

FIG. 5B is partial cross-sectional side view of an embodiment of the handle 106. In the illustrated embodiment, the rope 104 extends into the upper hinge portion 204, for example into the tube 208. In various embodiments, the rope 104 is secured to the upper hinge portion 204 via a clamp, a fastener, an adhesive, or any other reasonable coupling mechanism. The upper hinge portion 204 extends into the slot 302 formed between the arms 300 of the lower hinge portion 206 and is secured to the lower hinge portion 204 via the fastener 202, which is a pin in the illustrated embodiment. The clamp 500 is illustrated as securing the hinge mechanism 102 to the handle 106. However, as described above, the clamp 500 may also be utilized to tighten the rope 104 and/or the hinge mechanism 102 to add friction to the rotation of the hinge mechanism 102, for example via the rotary mechanism 306, relative to the longitudinal axis 308 of the handle 106. It should be appreciated that the rotary mechanism 306 has been removed from the illustrated embodiment for clarity, however, it should be appreciated that in various embodiments the rotary mechanism may be arranged about the lower hinge portion 206. In the illustrated embodiment, the clamp 500 may apply a frictional force to the lower hinge portion 206, thereby reducing rotation via the rotary mechanism, for example, slowing rotation within a journal bearing or by ball bearings facilitating rotation of the lower hinge portion 206.

Figure 6:
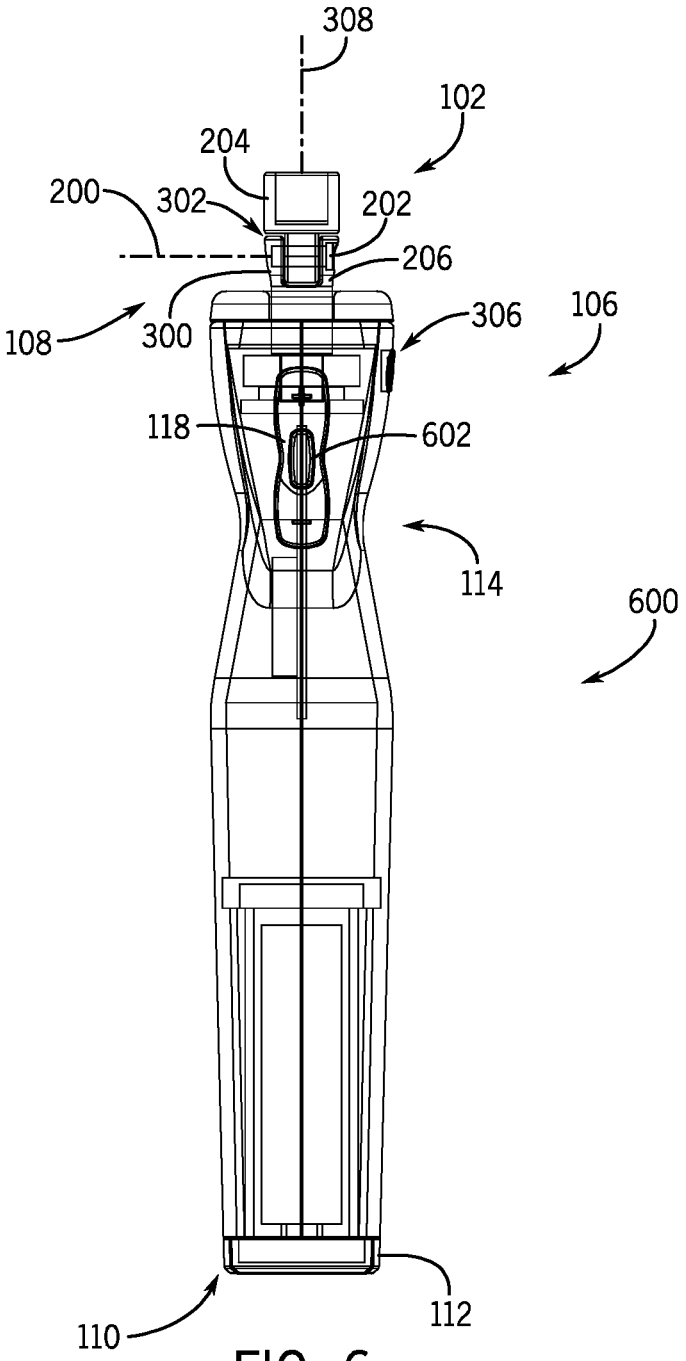
FIG. 6 is a side elevational view of an embodiment of a handle, in accordance with embodiments of the present disclosure.

FIG. 6 is a side elevational view of an embodiment of the handle 106 having the hinge mechanism 102 arranged at the first end 108. It should be appreciated that various portions of the handle 106 are illustrated as see through (such as a lower portion) or to include lines indicative of textures or elevation changes. The rope 104 has been removed for clarity. The illustrated handle 106 includes a body 600 having the contoured grip 114 for ergonomic purposes when the user interacts with the handle 106. As shown, the toggle switch 118 is arranged on the handle 106. In the illustrated embodiment, the toggle switch 118 further includes an enter button 602, which may be utilized to navigate a user menu, which may be visible on a display (not pictured). Moreover, as described above, in various embodiments the enter button 602 may double as the power switch 116. For example, a long press (e.g., above a threshold period of time) may be for power supply operation while a short press (e.g., below a threshold period of time) may be for selection or navigation purposes.

Further illustrated is the cap 112 arranged at the second end 110 of the handles 106. As described above, in various embodiments the cap 112 provides access to an interior portion of the handles 106. For example, the cap 112 may provide access to replace a battery, add weights to the handle 106, or the like. However, it should be appreciated that the cap 112 may be secured to the remainder of the body 600 to block access to the interior portions.

As described above, the rotary mechanism 306 is arranged proximate the first end 108, and is illustrated in FIG. 6 at a location where the body 600 is see-through for illustrative purposes. The rotary mechanism receives the lower hinge portion 206 within the body 600 to facilitate rotation of the lower hinge portion 206 about the longitudinal axis 308 of the handle 106. The illustrated embodiment further includes the fastener 202 for coupling the upper hinge portion 204 to the lower hinge portion 206. As shown, the upper hinge portion 204 extends into the slot 302 formed between the arms 300. As described above, in various embodiments, the upper hinge portion 204 may rotate about the axis 200.

Figure 7:
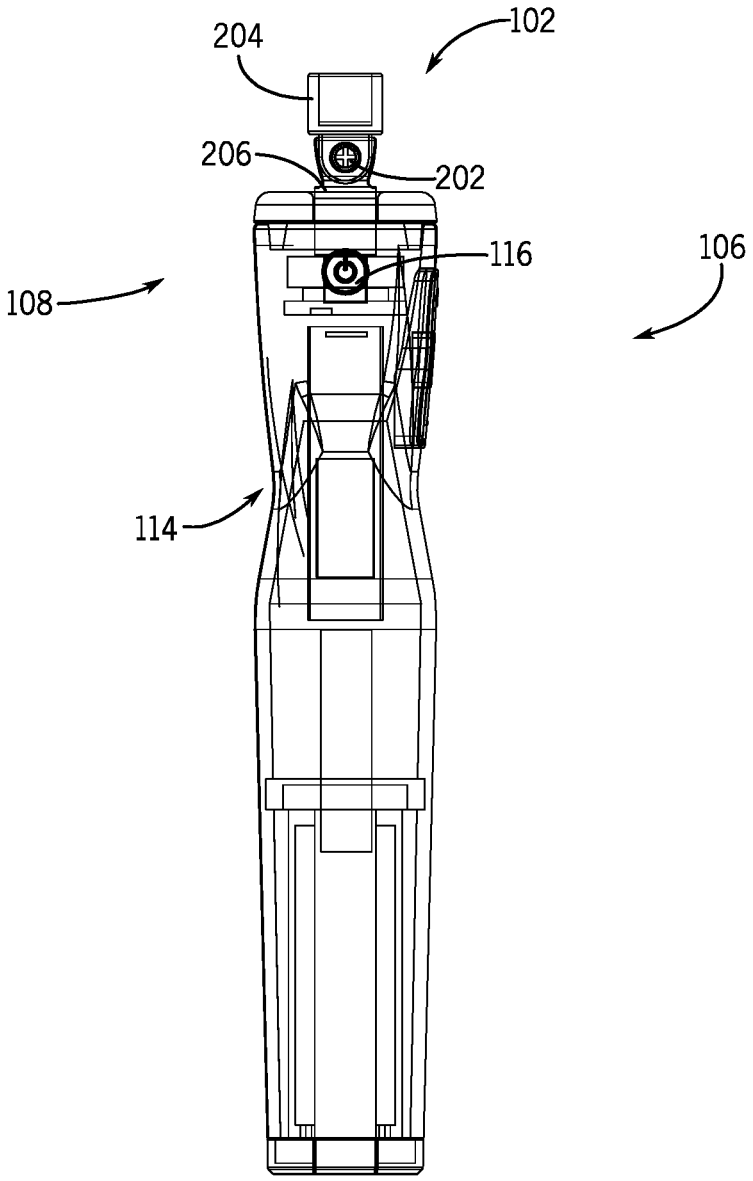
FIG. 7 is a side elevational view of an embodiment of a handle, in accordance with embodiments of the present disclosure.

FIG. 7 is a side elevational view of an embodiment of the handle 106 having the hinge mechanism 102 arranged at the first end 108 and the switch 116 (e.g., the on/off switch) arranged proximate the contoured grip 114. In certain embodiments, a display may also be arranged on the handle to provide information to the user, such as data related to an exercise program or usage information such as power availability and connectivity. The illustrated embodiment further includes the fastener 202 coupling the upper hinge portion 204 to the lower hinge portion 206, as described above. As described above, the fastener 202 enables rotation of the upper hinge portion 204 relative to the lower hinge portion 206 about the axis 200 extending through the fastener 202.

Figure 8:
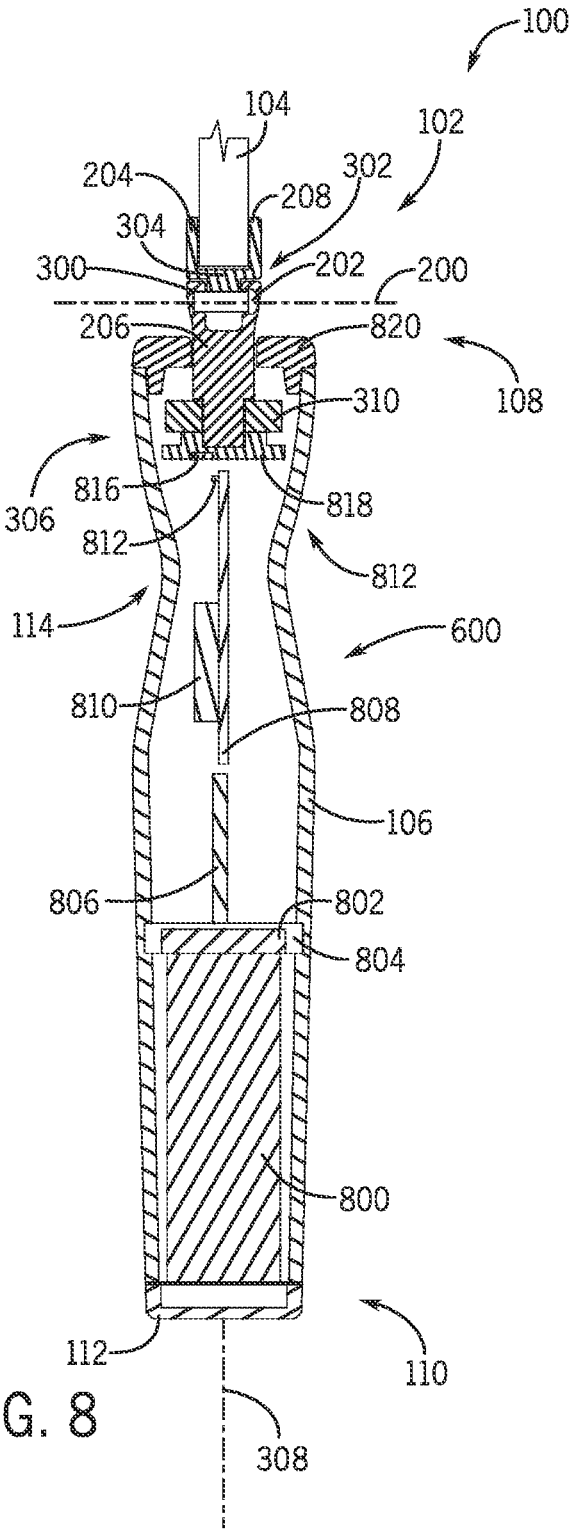
FIG. 8 is a schematic side elevational view of an embodiment of a handle, in accordance with embodiments of the present disclosure.

FIG. 8 is a schematic cross-sectional view of an embodiment of the handle 106. As described above, the handle 106 includes the body 600 having the contoured grip 114 to accommodate a human hand holding the handle 106. In the illustrated embodiment, the second end 110 of the handle 106 includes the cap 112 for securing the contents within the handle 106. A weight 800 is arranged within the handle proximate the cap 112. The weight 700 may be used to adjust the difficulty of the exercise program the user undergoes. For example, a heavier handle 106 may require more effort for the user to successfully rotate the handle 106 to move the rope 104 in the circular or arc-like movement. The illustrated embodiment also includes a magnet 802 proximate the weight 800 and a magnet enclosure 804 to secure the magnet 802 to the weight 800. The magnet 802 may secure the weight 800 into position to prevent the weight 800 from moving or throwing the handle 106 off balance.

As shown in FIG. 8, the handle further includes a display 806, which may be an Organic Light Emitting Diode (OLED) or any other type of display. In embodiments, the handle 106 has an opening or aperture to enable visibility of the display 806. Furthermore, it should be appreciated that while the display 806 is illustrated as being substantially centered within the body 600, the display 806 may be closer to the opening or aperture to improve visibility. In various embodiments, at least a portion of the handle 106, for example the portion proximate the display 806, is formed from a semi-transparent material to provide visibility of the display 806. The handle further includes a printed circuit board 808 (PCB) which may include a memory or processor for executing one or more programs stored on the memory. In the illustrated embodiment, a power source 810 is further included to provide operational power to the components, such as the display 806 and the PCB 808. The illustrated power source is a battery, which may be a rechargeable battery such as a lithium ion battery. While not shown in the illustrated embodiment, a port may be provided in the body 600 to receive a cable from a power supply to recharge the power source 810. Furthermore, in embodiments, the power source 810 may be rechargeable via other methods, such as electromagnetic induction.

In various embodiments, the jump rope 100 tracks a user's exercise progress by recording and displaying the number of rotations the jump rope makes over a period of time. In the illustrated embodiment, a sensor arrangement 812 (e.g., sensor assembly) includes a sensor 814 and a sensor magnet 816. The sensor magnet 816 is arranged on a disc enclosure 818, which is coupled to the rotary mechanism 306. As a result, when the rotary mechanism 306 rotates the disc enclosure 818 and therefore the sensor magnet 816, also rotate. As the sensor magnet 816 rotates past the sensor 814, a signal may be transmitted indicating one rotation of the rope, which may correspond to one rotation of the rotary mechanism 306. Accordingly, the sensor arrangement 812 may be utilized to track the number of rotations performed by the jump rope 100. In various embodiments, the sensor arrangement 812 may include a Hall Effect sensor. Furthermore, in embodiments, different sensors, or additional sensors, such as accelerometers, reflective sensors, interrupter sensors, optical encoders, variable-reluctance sensors, and the like may also be utilized.

As described above, the handle further includes the hinge mechanism 102 coupled to the rotary mechanism 306. As shown, the lower hinge portion 206 extends through the rotary mechanism 306 and is coupled to the rotary mechanism 306 such that rotation of the hinge mechanism 102 is enabled circumferentially about the longitudinal axis 308 of the handle 106. The illustrated rotary mechanism 306 may include a journal bearing and/or ball bearing 310 to facilitate rotation of the lower hinge portion 206 about the longitudinal axis 308. In various embodiments, the bearing 310 may be a journal bearing with a smooth finish and/or a dry lubricant that receives the lower hinge portion 206 through an aperture. Additionally, in embodiments, the bearing 310 may include ball bearings within an enclosure that facilitate rotation of the lower hinge portion 206.

Moreover, the upper hinge portion 204 extends into the slot 302 of the lower hinge portion 206 and is secured via the fastener 202. For example, the tab 304 extends into the slot 302 and includes one or more apertures to receive the fastener 202, which extends through corresponding apertures in the arms 300. The illustrated embodiment includes the rope 104 coupled to the upper hinge portion 204. As shown, the rope 104 extends into the upper hinge portion 204 and may be secured to the upper hinge portion 204, for example within the tube 208, as described above. In various embodiments, an upper cap 820 is positioned at the first end 108 of the handle 106 to secure the hinge mechanism 102 to the handle 106. In certain embodiments, the upper cap 820 restricts longitudinal movement of the hinge mechanism 102 and/or the rotary mechanism 306 along the longitudinal axis 308 of the handle. As a result, the hinge mechanism 102 is secured to the handle 106. In various embodiments, the clamp 500, described above, may be incorporated into the upper cap 820.

Figure 9:
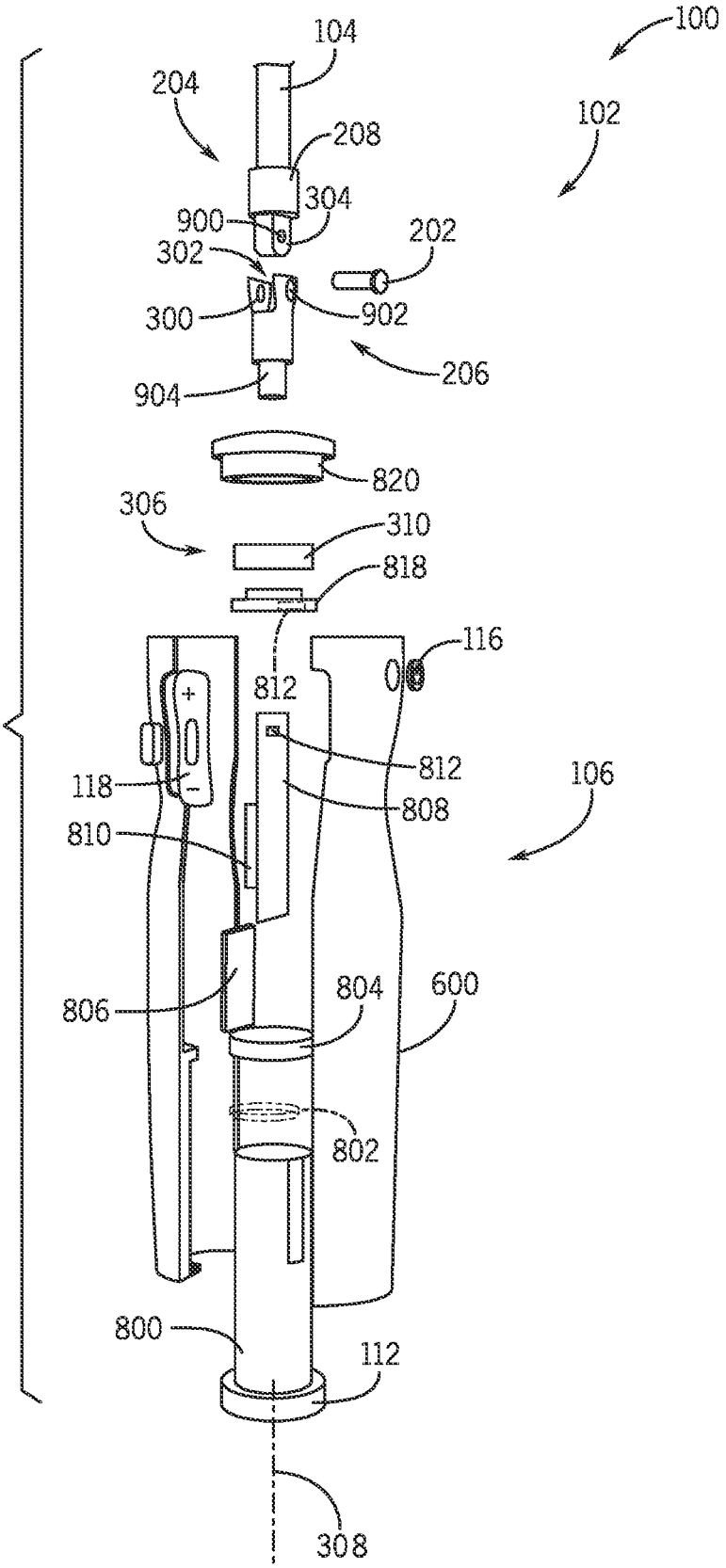
FIG. 9 is an exploded view of an embodiment of a handle, in accordance with embodiments of the present disclosure.

FIG. 9 is an exploded view of an embodiment of the handle 106. As described in detail above, the rope 104 is coupled to the upper hinge portion 204 which extends into the slot 302 formed by the arms 300 of the lower hinge portion 206. For example, the tab 304 that is coupled to the tube 208 and forms at least a portion of the upper hinge portion 204, in the illustrated embodiment, may be sized to enter the slot 302 such that an aperture 900 extending through the tab 304 aligns with apertures 902 extending through the arms 300. The upper hinge portion 204 is secured to the lower hinge portion 206 by the fastener 202, which enables rotational movement of the upper hinge portion 204 relative to the lower hinge portion 206 about the axis 200 extending through the fastener 202. The illustrated upper cap 820 secures the hinge mechanism 102 to the handle 106, for example to the body 600 of the handle 106, and restricts longitudinal movement of the hinge mechanism 102 along the longitudinal axis 308 of the handle 106. Moreover, in embodiments, the upper cap 820 may include the clamp 500 to apply a frictional force to adjust a rotational speed of the rotary mechanism 306. The hinge mechanism 102 extends into the rotary mechanism 306 to thereby enable rotational movement of the hinge mechanism 102 circumferentially about the longitudinal axis 308 of the handle 106. For example, an extension 904 of the lower hinge portion 206 may extend into an aperture formed within the rotary mechanism 306.

The sensor arrangement 812 is illustrated within the body 600 of the handle 106 and includes the sensor magnet 816 coupled to the disc enclosure 818. It should be appreciated that the disc enclosure 818 rotates along with the rotary mechanism 306, and as a result, the sensor magnet 816 rotates about the longitudinal axis 308 of the handle 106. The sensor arrangement 812 further includes the sensor 814 arranged on the PCB 808 at a fixed location. Accordingly, the sensor 814 will be activated when the sensor magnet 816 is positioned proximate the sensor 814, which may transmit a signal to the PCB to record one rotation of the rope 104.

Interior components of the handle 106 further include the display 806, which may be communicatively coupled to the PCB 808 and powered by the power source 810 arranged within the handle 106. In embodiments, the display 806 and the PCB 808 may receive signals indicative of instructions from the switch 116 and/or the toggle switch 118. These instructions may turn the jump rope off and on, move between menu options, and the like.

In the illustrated embodiment, the cap 112 includes the weight 800 which is positioned proximate the magnet 802 and the magnet enclosure 804. In certain embodiments, the cap 112 and weight 800 may be removable components that the user can change out to adjust their work out, that is, to increase the weigh to the handle 106 to make the work out more challenging. It should be appreciated that the cap 112 and weight 800 may be a joint component or singular components. The illustrated embodiment further includes a charging connector 906 for recharging the power source 810.

Figure 10:
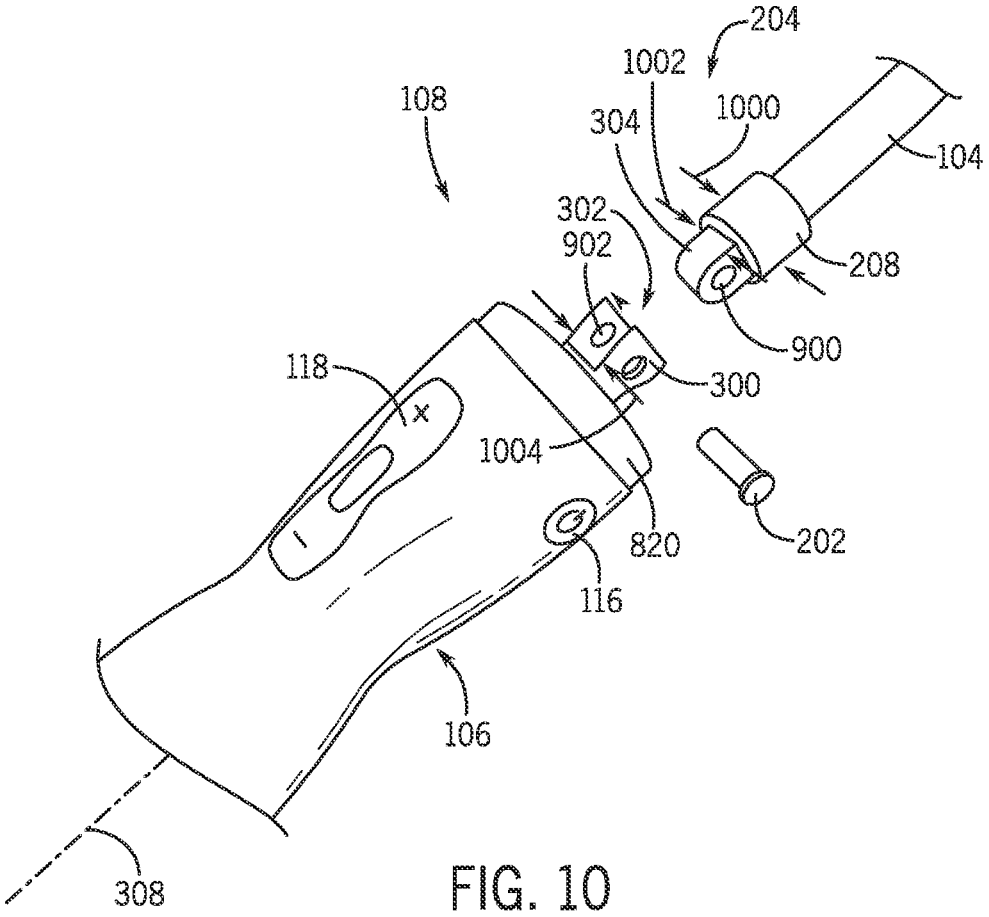
FIG. 10 is a partial detailed view of an embodiment of a hinge mechanism, in accordance with embodiments of the present disclosure.

FIG. 10 is a detailed perspective view of the hinge mechanism 102. As illustrated, the lower hinge portion 206 extends out of the first end 108 of the handle 106. In embodiments, the lower hinge portion 206 is secured to the handle 106 and longitudinal movement along the longitudinal axis 308 of the handle 106 is restricted by the upper cap 820. The lower hinge portion 206 includes the arms 300 that form the slot 302 for receiving the upper hinge portion 204. The apertures 902 extend through each of the arms 300 and align with the corresponding aperture 900 on the tab 304 of the upper hinge portion 204 to receive the fastener 202 and secure the upper hinge portion 204 to the lower hinge portion 206. In various embodiments, the arms 300 may include a profile, such as a triangular profile, to improve strength and reduce weight.

The illustrated upper hinge portion 204 includes the tab 304, which may be referred to as an attachment member, and the tube 208, which may be referred to as a body member. As illustrated, a diameter 1000 of the body member 208 is larger than a second diameter 1002 the attachment member 304. The size of the attachment member 304 may be particularly selected to correspond to a width 1004 of the slot 302 formed in the lower hinge portion 206. In operation, the attachment member 304 is positioned within the slot 302 and the fastener 202 extends through the respective apertures 900, 902 to secure the upper hinge portion 204 to the lower hinge portion 206. The illustrated fastener 202 will serve as a pivot to enable rotation of the upper hinge portion 204 relative to the lower hinge portion 206 about the axis 200 that extends through the fastener 202. In the illustrated embodiment, the rope 104 is secured to the upper hinge portion 204, as described above.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A system, comprising:

a handle having a substantially hollow body;

a hinge mechanism extending at least partially into the substantially hollow body, the hinge mechanism including a lower hinge portion and an upper hinge portion rotatably coupled together such that the upper hinge portion rotates about a hinge axis arranged substantially perpendicular to a handle axis;

a rotary mechanism positioned at least partially within the substantially hollow body and coupled to the lower hinge portion, the rotary mechanism configured to enable rotation of the lower hinge portion about the handle axis;

an upper cap positioned to cover an opening within the handle, the hinge mechanism extending at least partially through the upper cap, the upper cap being secured to the handle to restrict longitudinal movement of the hinge mechanism along the handle axis; and a sensor arrangement positioned within the substantially hollow body, the sensor arrangement measuring a number of rotations of the rotary mechanism about the handle axis.

2. The system of claim 1, further comprising:

an adjustable friction element configured to apply a frictional force to the lower hinge portion to resist rotation of the lower hinge portion.

3. The system of claim 2, wherein the adjustable friction element forms at least a portion of the upper cap.

4. The system of claim 1, wherein the handle has a contoured shape.

5. The system of claim 1, wherein the hinge mechanism further comprises:

a tube forming at least a portion of the upper hinge portion; and a tab extending longitudinally from the tube, the tab having a smaller diameter than the tube, the tab being coupled to the lower hinge portion.

6. The system of claim 1, further comprising:

a slot formed in the lower hinge portion, the slot receiving the upper hinge portion; and apertures extending through the lower hinge portion and the upper hinge portion, wherein a fastener extends through the apertures when the upper hinge portion is arranged within the slot to couple the upper hinge portion to the lower hinge portion.

7. The system of claim 1, further comprising:

a magnetic sensor of the sensor arrangement, wherein the magnetic sensor includes a fixed sensor and a magnet, the magnet being coupled to the rotary mechanism;

one or more processors;

a memory; and a power supply.

8. A system, comprising:

a handle having a void space;

a hinge mechanism, comprising:

a lower hinge portion positioned at least partially within the void space;

an upper hinge portion, coupled to the lower hinge portion, and positioned outside of the void space; and a pivot point to enable the upper hinge portion to rotate about a hinge axis relative to the lower hinge portion;

a rotary mechanism coupled to the lower hinge portion at a reduced diameter area to enable rotation about a longitudinal axis extending through the handle;

a sensor assembly positioned within the void space, the sensor assembly comprising:

a sensor positioned on the rotary mechanism; and a magnetic sensor arranged proximate to the rotary mechanism, the magnetic sensor positioned to count a number of rotations of the rotary mechanism; and an adjustable friction element configured to apply a frictional force to the hinge mechanism.

9. The system of claim 8, further comprising:

an upper cap positioned proximate to the hinge mechanism to cover an opening to the void space, the hinge mechanism extending at least partially through the upper cap, the upper cap being secured to the handle to block longitudinal movement of the hinge mechanism along the longitudinal axis.

10. The system of claim 9, wherein the adjustable friction element forms at least a portion of the upper cap.

11. The system of claim 8, wherein the handle has a contoured shape.

12. The system of claim 8, further comprising:

a printed circuit board (PCB) associated with the sensor assembly, the PCB configured to receive information from the magnetic sensor.

13. The system of claim 8, further comprising:

a display, the displaying being visible through an opening formed in the handle.

14. The system of claim 8, further comprising:

a switch arranged on the handle, the switch being communicatively coupled to a power supply, the switch toggling the sensor assembly between an on state and an off state.

15. The system of claim 8, further comprising:

a rotation limiter associated with the upper hinge portion, the rotation limiter restricting rotation of the upper hinge portion about the hinge axis within a predetermined range.

16. The system of claim 15, wherein the predetermined range is between 90 degrees and 220 degrees.

17. An exercise system, comprising:

a rotating hinge mechanism configured to rotate about a longitudinal axis and to enable rotation about a hinge axis, the hinge axis being perpendicular to the longitudinal axis, the rotating hinge mechanism having a lower hinge portion and an upper hinge portion, wherein the hinge axis extends through an interface between the lower hinge portion and the upper hinge portion; and a cap associated with the rotating hinge mechanism, the cap having an opening that receives at least a portion of the rotating hinge mechanism, wherein the cap is positioned to apply a frictional force to at least a portion of the rotating hinge mechanism to resist rotation about the longitudinal axis.

18. The exercise system of claim 17, further comprising:

a body portion coupled to the rotating hinge mechanism via the cap; and a sensor arrangement positioned within the body portion, the sensor arrangement configured to determine a number of rotations about the longitudinal axis.

19. The exercise system of claim 17, further comprising:

a rotary mechanism coupled to the lower hinge portion, the rotary mechanism secured to the lower hinge portion to block axial movement along the longitudinal axis beyond a predetermine amount.

20. The exercise system of claim 17, wherein an end of the upper hinge portion is positioned within a slot in the lower hinge portion, the upper hinge portion and lower hinge portion coupled together via a fastener, the fastener permitting rotation about the hinge axis, wherein the rotation is restricted by an increased diameter portion of the upper hinge portion.

* * * * *